US005258276A

United States Patent [19]

Schoenberg et al.

[11] Patent Number: 5,258,276

[45] Date of Patent: Nov. 2, 1993

[54] TERNARY SURFACTANT SYSTEM TO REDUCE STATIC IN PHOTOGRAPHIC SILVER HALIDE SYSTEMS

[75] Inventors: Allan R. Schoenberg, Asheville, N.C.; Ming-tsai Shu, Hockessin, Del.

[73] Assignee: E. I. Du Pont de Nemours and Company, Wilmington, Del.

[21] Appl. No.: 885,063

[22] Filed: May 15, 1992

Related U.S. Application Data

[63] Continuation of Ser. No. 627,872, Dec. 13, 1990, abandoned, which is a continuation of Ser. No. 511,801, Apr. 16, 1990, abandoned, which is a continuation of Ser. No. 129,805, Dec. 7, 1987, abandoned.

[51] Int. Cl.[5] ..... G03C 1/85

[52] U.S. Cl. ..... 430/527; 430/526; 430/528

[58] Field of Search ..... 430/527, 526, 528, 271

[56] References Cited

U.S. PATENT DOCUMENTS

| | | | |
|---|---|---|---|
| 3,317,344 | 5/1967 | Mackey et al. | 430/527 |
| 4,047,958 | 9/1977 | Yoneyama et al. | 430/527 |
| 4,366,238 | 12/1982 | Yokoyama et al. | 430/527 |
| 4,367,283 | 1/1983 | Nakayama et al. | 430/528 |
| 4,582,781 | 4/1986 | Chen et al. | 430/527 |
| 4,596,766 | 6/1986 | Nemori et al. | 430/527 |
| 4,649,102 | 3/1987 | Mukunoki et al. | 430/526 |
| 4,675,278 | 6/1987 | Sugimoto et al. | 430/527 |

FOREIGN PATENT DOCUMENTS 0242853 10/1987 European Pat. Off. .

*Primary Examiner*—Jack P. Brammer

[57] ABSTRACT

A ternary surfactant system useful in reducing the propensity of silver halide elements to generate unwanted static is described. This ternary system comprises a mixture of a specific anionic and two specific nonionic surfactants and produces a surprising synergistic result. A solution of this ternary system is also useful in reducing static produced on the surface of an X-ray intensifying screen.

1 Claim, 2 Drawing Sheets

TERNARY SURFACTANT SYSTEM TO REDUCE STATIC IN PHOTOGRAPHIC SILVER HALIDE SYSTEMS

This application is a continuation of Ser. No. 07/627,872, Dec. 13, 1990 now abandoned, which is a continuation of Ser. No. 07/511,801, Apr. 16, 1990 now abandoned, which is a continuation of Ser. No. 07/129,805, Dec. 7, 1987 now abandoned.

FIELD OF THE INVENTION

This invention relates to photographic silver halide systems and to elements used therewith. More specifically, this invention relates to a specific ternary surfactant system capable of reducing the propensity of these elements to generate static. Still more specifically, this invention relates a ternary surfactant system comprising a mixture of one anionic surfactant and two nonionic surfactants, said system being capable of producing synergistic results in the reduction of static on elements associated therewith.

BACKGROUND OF THE INVENTION

Most silver halide elements are coated on to film substrates to form the final product structure. A very large number of these silver halide elements suffer from defects caused by the presence of static which can be generated thereon. The generation of this static is usually caused by film elements sliding across each other or against other elements associated therewith (e.g. camera parts, intensifying screens, processing units, for example). Static defects are particularly onerous when present in a medical X-ray element, for example. Here, a small static discharge might be medically mistaken for a lesion or other suspected fault within the patient, for example, and a misdiagnosis might result. There are a host of prior art references which describe the use of agents useful in reducing or preventing this static buildup. Most of these agents are surfactants and the like. Some of these references describe the use of mixtures of one or more of these surfactants to achieve these beneficial results.

Antistatic agents, when present in a photographic element, may be added to any of the layers used therewith. For example, they may be present in the silver halide emulsion layer or in a backing layer or an overcoat layer. In medical X-ray elements, it is conventional to add these ingredients to the overcoat layer or layers since static is usually a surface generated defect.

SUMMARY OF THE INVENTION

It is an object of this invention to provide a silver halide, photographic element with reduced propensity to generate static. It is another object of this invention to prepare a ternary surfactant system which can be used to reduce static in all elements related to silver halide X-ray films and elements associated therewith. These and yet other objects are achieved by providing an antistatic composition for a photographic element comprising a mixture of:

(i) an anion surfactant of the following structure:

$$R—X—Y—M$$

wherein R is alkyene; alkyl; alkylcarboxylate; aryl; alkylaryl; alkylenyl; alkoxy; alkylamido; alkylsulfoamido; perfluoroaryl; alkylarylamido; perfluoro; perfluoroakyl, perfluoroamido; perfluorosulfoamido or siloxyl, and wherein alkyl is 1 to 100 carbon atoms and aryl is 6 to 10 carbon atoms; X is:

$$—(CH_2—CH_2—O)_a—(CH_2—CH_2—CH_2—O)_b—C_nH_{2n}—;$$

$$—(O—CH_2—CH_2)_a—(O—CH_2—CH_2—CH_2)_b—C_nH_{2n}—;$$

or mixtures thereof and a is 1 to 50, b is 0 to 50 and n is 0 to 5; Y is:

$$—SO_3^-;\ —PO_3^-;\ —O—SO_3^-;\ —CO_2^-;$$

$$—O_2C—\underset{}{\overset{SO_3^-}{\overset{|}{CH}}}—CH_2—CO_2H;\ \text{and,}\ —\overset{NH_2}{\overset{|}{C}}—CO_2^-;$$

and M is alkali metal, ammonium or an alkylammonium group;

(ii) a nonionic surfactant of the following structure:

$$R^1—X—A$$

wherein $R^1$ is alkylene; alkyl; alkylcarboxylate; aryl; alkylaryl; alkyenyl; alkylamido; alkylarylamido; alkylsulfoamido; or alkoxy, where alkyl is 1 to 100 carbon atoms and aryl is 6 to 10 carbon atoms: X is as shown in (i) and

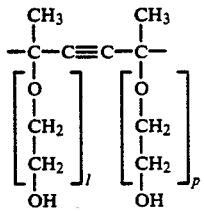

where 1 plus p is 3-36; and where A is —OH, H or R, where R is the same as (i); and (iii) a nonionic surfactant selected from the group consisting of

I.

$$R_f—B—X—A$$

where: $R_f$ is $C_zF_{2z+1}$, where z is 3-15; B is $—(CH_2)_t$, where t is 0 to 10;

$$—\underset{Q}{\underset{|}{CON}}—;\ —O—;\ \text{or}\ SO_2—\underset{Q}{\underset{|}{N}}—R^2—$$

where Q is H or $CH_3$ and $R^2$ is $(CH_2)_s$—, or CO and s is 0-5; X is the same as in (i), above; and A is the same as in (ii), above;

II.

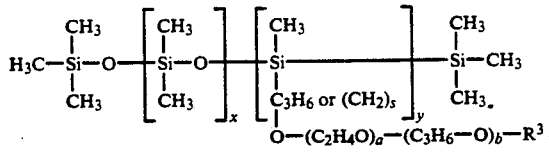

wherein x is 0 to 50; y is 1–10; $R^3$ is an alkyl of 1 to 5 carbon atoms, and a and b are as in (i), and s is as in I, above.

III.

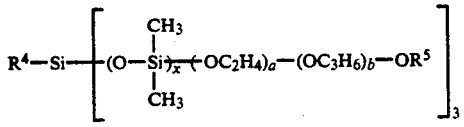

$R^4$ and $R^5$ are alkyl of 1 to 5 carbon atoms; x is is as in II and a and b are as in (i), above; and

IV.

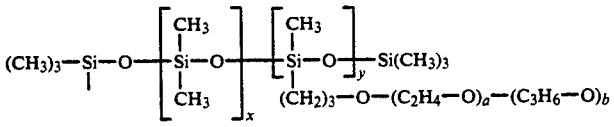

wherein x and y are as in II, above, and a and b are as in (i), above.

When this ternary system is added to the overcoat layer of a silver halide, photographic element, for example, the propensity of this element to generate unwanted static buildup is greatly reduced. In fact, a specific synergistic result was noted with this combination of surfactants used as an antistatic mixture, a result which was greatly surprising.

In yet another embodiment, this ternary system can be used to reduce static on an X-ray intensifying screen by application of a solution of these surfactants supra to the topcoat of said intensifying screen. It is conventional to apply this solution as a "wipe-on", for example.

DETAILS OF THE INVENTION

Figure 1:
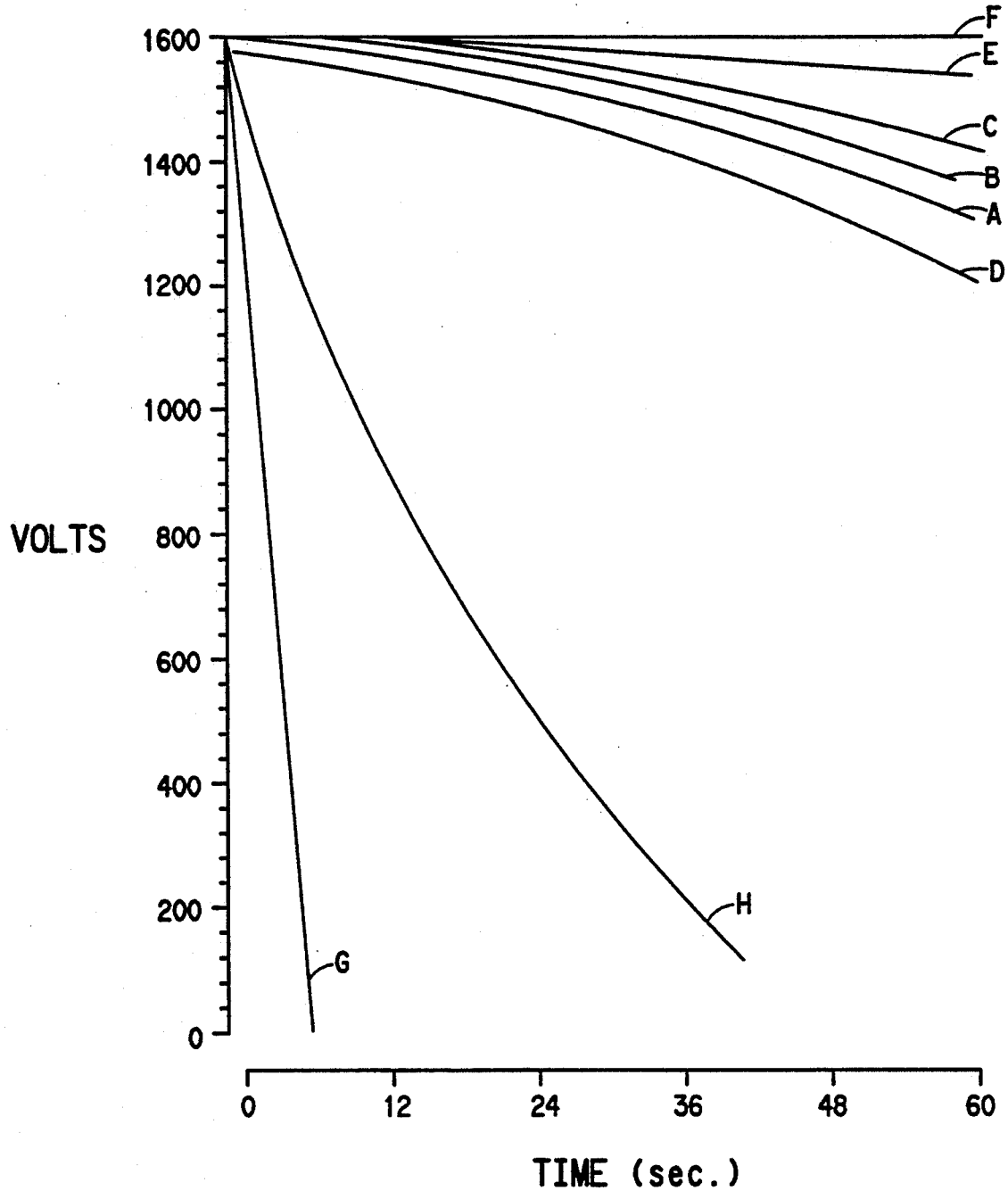
FIG. 1 is a drawing showing a plot of the decrease in static (volts, as measured by an instrument) vs time. In this figure, several plots of individual surfactants and mixtures of two are shown vs the invention, in which three are added to produce a beneficial and synergistic result.

The ternary surfactant system of this invention is particularly useful in reducing static buildup and subsequent unwanted discharge on medical X-ray elements (e.g. films and intensifying screens, for example). Here, light produced by the discharge of static has extremely deleterious results since a mis-diagnosis may occur. However, the ternary surfactant system of this invention may find use in any of the conventional silver halide elements such as graphic arts products, cineographic elements, etc. In these cases, any of the conventional silver halides can be used (chloride, bromide, iodide or mixtures of two or more, for example). Most conventional silver halide elements are coated on film supports made from a host of conventional elements well known to those of normal skill in the art. Usually, it is conventional to use dimensionally stable, polyethylene terephthalate to which has been applied a conventional resin sub layer over which a thin, substratum of hardened gelatin is then coated. The silver halide emulsion layer is applied supra to this get sub layer. In the case of X-ray elements, silver halide layers are usually applied to both sides of the support and thus both sides must be suitably subbed as described above. A gelatin antiabrasion layer is usually applied over the silver halide emulsion layer to protect the layer during use. This layer may also contain hardeners and wetting agents. We prefer adding our ternary surfactant system to this antiabrasion layer since it is the uppermost layer within the system and is most likely to come in contact with other elements during use. Thus, static will be generated when this contact is made. It may be advantageous in some elements, however, to add some of the ternary surfactants to other layers.

Examples of typical anionic surfactants which meet the limitations of (i), above include the following:

| IDENTITY | COMPOUND | MANUFACTURER |
|---|---|---|
| i-a | Triton ® X-200 | Rhom & Haas |
| i-b | Triton ® X-202 | Rhom & Haas |
| i-c | Triton ® X-301 | Rhom & Haas |
| i-d | Polystep ® B-27 | Stephan |
| i-e | Neodol ® 25-3A | Shell |
| i-f | Neodol ® 25-3S | Shell |
| i-g | Standapol ® ES-3 | Henkel |
| i-h | Standapol ® 125E | Henkel |
| i-i | Standapol ® ES-40 | Henkel |
| i-j | Emphos ® PS-400 | Witco |
| i-k | Emphos ® PS-236 | Witco |
| i-l | Emphos ® CS-1361 | Witco |
| i-m | Emphos ® TS-230 | Witco |
| i-n | Emphos ® CS-141 | Witco |
| i-o | Tegopren ® 6974 | Goldschmidt |

Examples of compounds which are nonionic and meet the limits of (ii), above, include:

| IDENTITY | COMPOUND | MANUFACTURER |
|---|---|---|
| ii-a-I | Tween ® 20 | ICI |
| ii-a-II | Tween ® 60 | ICI |
| ii-a-III | Tween ® 80 | ICI |
| ii-b-I | Brij ® 56 | ICI |
| ii-b-II | Brij ® 58 | ICI |
| ii-b-III | Brij ® 96 | ICI |
| ii-b-IV | Brij ® 97 | ICI |
| ii-b-V | Brij ® 98 | ICI |
| ii-c-I | Renex ® 30 | ICI |
| ii-c-II | Renex ® 31 | ICI |
| ii-d | EL-449 | ICI |

-continued

| IDENTITY | COMPOUND | MANUFACTURER |
|---|---|---|
| ii-e | EL-4083 | ICI |
| ii-f | Myrj ® 53 | ICI |
| ii-g-I | Pluracol ® WS100N | BASF |
| ii-g-II | Pluracol ® W170 | BASF |
| ii-h-I | Plurafac ® RA-20 | BASF |
| ii-h-II | Plurafac ® RS-30 | BASF |
| ii-i-I | Pluronic ® 25R4 | BASF |
| ii-i-II | Pluronic ® 25RS | BASF |
| ii-i-III | Pluronic ® L63 | BASF |
| ii-i-IV | Pluronic ® L64 | BASF |
| ii-i-V | Pluronic ® F38 | BASF |
| ii-i-VI | Pluronic ® F68 | BASF |
| ii-i-VII | Pluronic ® P65 | BASF |
| ii-j-I | Surfynol ® 440 | Air Products |
| ii-j-II | Surfynol ® 665 | Air Products |
| ii-j-III | Surfynol ® 685 | Air Products |
| ii-k-I | Neodol ® 25-7 | Shell |
| ii-k-II | Neodol ® 25-9 | Shell |
| ii-k-III | Neodol ® 25-12 | Shell |
| ii-l-I | Triton ® X-100 | Rohm & Haas |
| ii-l-II | Triton ® X-102 | Rohm & Haas |
| ii-l-III | Triton ® X-114 | Rohm & Haas |
| ii-l-IV | Triton ® X-165 | Rohm & Haas |
| ii-l-V | Triton ® X-305 | Rohm & Haas |
| ii-l-VI | Triton ® X-405 | Rohm & Haas |
| ii-l-VII | Triton ® N-87 | Rohm & Haas |
| ii-l-VIII | Triton ® N-101 | Rohm & Haas |
| ii-l-IX | Triton ® N-302 | Rohm & Haas |
| ii-l-X | Triton ® N-401 | Rohm & Haas |
| ii-m-I | Igepal ® CO720 | GAF |
| ii-m-II | Igepal ® CO850 | GAF |
| ii-m-III | Igepal ® DM730 | GAF |
| ii-m-IV | Igepal ® DM880 | GAF |
| ii-m-V | Igepal ® CA720 | GAF |
| ii-m-VI | Igepal ® CA887 | GAF |
| ii-n-I | Ethox ® CO36 | Ethox |
| ii-n-II | Ethox ® CO40 | Ethox |
| ii-n-III | Ethox ® TO16 | Ethox |
| ii-n-IV | Ethox ® MS14 | Ethox |
| ii-n-V | Ethox ® MS23 | Ethox |
| ii-n-VI | Ethox ® MS40 | Ethox |
| ii-n-VII | Ethox ® TAM15 | Ethox |
| ii-n-VIII | Ethox ® TAM20 | Ethox |
| ii-n-IX | Ethox ® TAM25 | Ethox |
| ii-n-X | Ethox ® CAM-15 | Ethox |
| ii-n-XI | Ethox ® SAM-50 | Ethox |
| ii-o-I | Chemex ® NP-10 | Chemex |
| ii-o-II | Chemex ® NP-15 | Chemex |
| ii-o-III | Chemex ® NP-30 | Chemex |
| ii-o-IV | Chemex ® NP-40 | Chemex |
| ii-o-V | Chemex ® T-10 | Chemex |
| ii-o-VI | Chemex ® T-15 | Chemex |
| ii-p-I | Chemex ® T06 | Chemex |
| ii-p-II | Chemex ® OP 40/70 | Chemex |
| ii-q-I | Emulphogene ® BC610 | GAF |
| ii-q-II | Emulphogene ® BC720 | GAF |
| ii-q-III | Emulphogene ® BC840 | GAF |
| ii-r-I | Amidox ® C-5 | Stephan |
| ii-r-II | Amidox ® L-5 | Stephan |
| ii-s-I | Accumene ® C10 | Capital City |
| ii-s-II | Accumene ® C15 | Capital City |
| ii-t-I | Sandoxylate ® SX 412 | Sandoz |
| ii-t-II | Sandoxylate ® SX 418 | Sandoz |
| ii-u-I | Standapon ® JA-36 | Sandoz |
| ii-u-II | Standapon ® LS-24 | Sandoz |

Examples of compounds which are nonionic and meet the limitations of (iii), above, include:

| IDENTITY | COMPOUND | MANUFACTURER |
|---|---|---|
| iii-a | Zonyl ® FSN | Du Pont |
| iii-b | Fluorad ® FC-170C | 3M |
| iii-c | Fluowet ® OT | Hoechst |
| iii-d | FT-219 | Bayer (Mobay) |
| iii-e | Forfac ® 1110 | ATO CHEM |
| iii-f | Lodyne ® S107B | Ciba-Geigy |
| iii-g | ABIL ® B8842 | Goldschmidt |
| iii-h | ABIL ® B8843 | Goldschmidt |

-continued

| IDENTITY | COMPOUND | MANUFACTURER |
|---|---|---|
| iii-i | ABIL ® B8851 | Goldschmidt |
| iii-j | ABIL ® B8866 | Goldschmidt |
| iii-k | ABIL ® B8878 | Goldschmidt |
| iii-l | ABIL ® B8894 | Goldschmidt |
| iii-m | Silwet ® L-77 | Union Carbide |
| iii-n | Silwet ® L-720 | Union Carbide |
| iii-o | Silwet ® L-7601 | Union Carbide |
| iii-p | Silwet ® L-7602 | Union Carbide |
| iii-q | Silwet ® L-7604 | Union Carbide |
| iii-r | Silwet ® L-7605 | Union Carbide |
| iii-s | Silwet ® L-7607 | Union Carbide |
| iii-t | Dow Corning ® 190 | Dow Corning |
| iii-u | Dow Corning ® 193 | Dow Corning |
| iii-v | Dow Corning ® 197 | Dow Corning |
| iii-w | Dow Corning ® 1315 | Dow Corning |

The addresses of the manufacturers of the surfactants listed above are as follows:

Rhom & Haas Co., Independence Hall West, Philadelphia, Pa. 19103

Stephan Chemical Co., Northfield, Ill. 60093

Shell Chemical Co., P.O. Box 1496, Atlanta, Ga. 30371

Henkel Corp., 1301 Jefferson St., Hoboken, N.J. 07030

Witco Chem. Corp., 90 N. Shiawassee Ave., Akron, Ohio 44313

Goldschmidt Chem. Co., Rt. 2, Box 1299, Hopewell, Va. 23860

Bayer (Mobay) Chem. Corp., Penn Lincoln Parkway W, Pittsburgh, Pa. 15205

ICI Co., Wilmington, Del. 19898

BASF Wyandotte Corp., 100 Cherry Hill Rd., Parsippany, N.J. 07054

Air Products and Chem., Inc., Box 538, Allentown, Pa. 18105

Ethox Chem. Co., P.O. Box 5094, Greenville, S.C. 29606

Hoechst, 6230 Frankfurt am Main 80, W. Germany.

GAF Co., 1361 Alps Rd., Wayne, N.J. 07470

Chemex Co., P.O. Box 6067, Greenville, S.C. 29606

Capital City Prod. Co., Armstrong Chem. Plt., 1530 S. Jackson St., Jamesville, Wis. 53545

Sandoz Chem. Corp., 4000 Monroe Rd., Charlotte, N.C. 28205

E. I. du Pont de Nemours and Company, Wilmington, Del. 19898

3M Co., Minneapolis, Minn.

Union CArbide Co., 39 Old Ridgebury Rd., Danbury, Conn. 06817-0001

ATO Chem. Co., P.O. Box 607, Glen Rock, N. J. 07452

Ciba-Geigy Corp. Co., Ardsley, N. Y. 10502-2699

Dow Corning Chem. Co., Midland, Miss. 48686-0997.

In preparing films and elements within the ambit of this invention, the photographic element was prepared in a conventional manner. Thus, for a typical medical X-ray element, containing ca. 98% bromide and ca. 2% iodide, the grains were brought to their optimum sensitivity with gold and sulfur compounds, for example, as well known to those of normal skill in the art. These grains may be made by conventional methods and may be cubic or tabular in nature for example. Sensitizing dyes may or may not be present depending on the final use therefor. Wetting agents, antifoggants, hardeners and the like may also be added to this emulsion as is well-known. The emulsions were coated on both sides of the support in the normal manner as described above. An antiabrasion solution of gelatin, polyvinylpyrrolidone, polymethylmethacrylate, for example, was then prepared. Hardeners may also be added to this solution. A selected system representing the ternary surfactant system of this invention was then added to this antiabrasion solution which was then coated supra to over the silver halide layers. For purposes of testing within the ambit of this invention, only single side coatings were made. After coating and drying, samples of the coatings were taken and tested for a propensity to produce static using a Model 276A Monroe Static Generator, Monroe Electronics, Inc., 100 Housel Ave., Lyndonville, N.Y. 14098. This unit was interfaced with a DEC PDP 11/44 Computer. In a specific instance, samples were equilibrated to 20% relative humidity at 70° F. for at least one hour. Two, 1 inch diameter samples were placed on the aluminum turntable of the Monroe unit and, at 600 rpm and 60 Hz, with the side to be tested down, charged with a corona unit using 0.004" diameter wire spaced ⅜" from the sample and powered by a +10 Kv, 1.5 mA current (maximum). All samples were charged at 80% maximum power output as recommended by the manufacturer of this unit. Voltage acceptance of each sample was determined by recording the initial voltage. When the current charge is released, the charge decay can be observed on the voltmeter and automatically recorded by the computer vs. time. A typical print-out of this data is represented by the two figures attached hereto. Regression of log volts vs time provides the correlation from which $t_{\frac{1}{2}}$ (half-time) is calculated. A table of $t_{\frac{1}{2}}$ is an excellent, quantitative method for comparing static decay data and correlates well with results found under actual use (e.g. processing of medical X-ray films through an automatic changer, for example). Under these conditions, the following conclusions can be made from films passed through this test:

| | Initial Volts | $t_{\frac{1}{2}}$ (sec) |
|---|---|---|
| A Excellent Static Performance | <1300 | <5 |
| B Very Good Static Performance | 1300–1400 | 5–20 |
| C Good Static Performance | 1400–1475 | 20–40 |
| D Fair Static Performance | 1475–1550 | 40–100 |
| E Poor Static Performance | >1550 | >100 |

Film which has an Initial Volt of >1550 and $t_{\frac{1}{2}}$<100 sec. fell into the E category also. Using combinations presented herein, Initial volts lower than 1100 and $t_{\frac{1}{2}}$<1 sec. were obtained.

Referring now specifically to the drawings, FIG. 1 is a plot obtained from a computer print-out from the above mentioned test. In this case, "A" is a plot of a single surfactant $R_f—CH_2—CH_2—O(CH_2CH_2—O)_xH$ (iii) (Zonyl ® FSN) used in the antiabrasion layer, "B" yet another single surfactant octylphenoxypolyethoxyethanol (ii) (Triton ® X-100), "C" yet another single surfactant (i) sodium octylphenoxypolyethoxyethylsulfonate (i) (Triton ® X-200). "D" is the combination of A and B, "E" the combination of A and C, and "F" the combination of B and C. "G" represents the ternary surfactant system of this invention which is the combination of A, B and C and "H" the same combination at a lower, concentration. As can be readily seen from this figure, plots A through F did not produce acceptable static performance while H and G show synergistic results in that the static performance was vastly improved over single component or binary combinations thereof.

Figure 2:
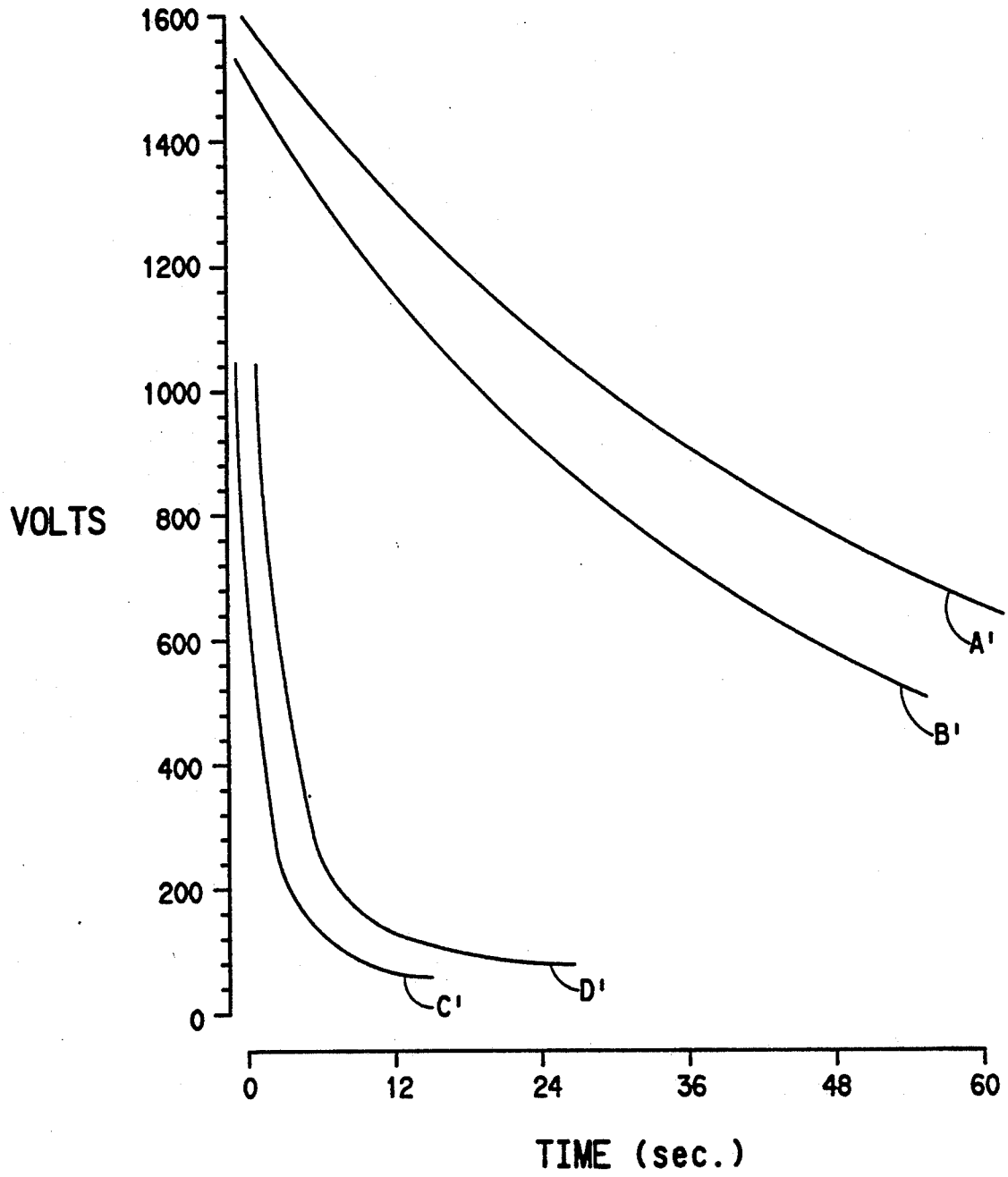
FIG. 2 is a drawing similar to that of FIG. 1 in which the surfactants are wiped-on a typical X-ray intensifying screen. In this figure, individual solutions of surfactants are shown vs the ternary system of this invention. Thus, the synergistic result from using the ternary surfactant system of this invention can also be clearly seen here.

FIG. 2 shows plots of the use of the ternary surfactant system of this invention to reduce static on the surface of a typical X-ray intensifying screen. In this figure, plot "A'" represents the effect of no treatment to the screen surface and plot "B'" represents a simple water cleaning of a similar screen. These two plots indicate that a significant static charge can still be found from this test. Plot "C'" shows the effect of using a mixture of 65% Renex ®31, 22% Standapol ®ES 3 and 13% Silwet ®L-77 as a 2.5% solution in deionized water to "wipe-on" the screen. And, plot "D'" shows the effect of a similar ternary surfactant system comprising 65% Renex ®31, 22% Standapol ®ES-3 and 13% Lodyne ®S107B as the mixture (2.5% solution in deionized water). These tests indicate that ternary surfactant mixtures in the metes and bounds of this invention can significantly reduce the static build-up on an X-ray screen surface, when polyethylene(15)tridecylether (ii) (Renex ®31), $CH_3(CH_2)_{10}CH_2O(CH_2CH_2O)_3SO_3Na$ (i) (Standapol ®ES-3), and copolymer of dimethylpolysiloxane and polyalkylene oxide (iii) (Silwet ®L-77) is wiped on at two different concentrations. Thus the surprising results achieved in static reduction are readily seen from this figure. Typically, we prefer to make up a solution of 65% of (i), 22% of (ii) and 13% of (iii). Typical solvents for the ternary antistatic surfactant system of this invention include water, alcohols, acetones, and mixtures thereof, etc., among minor amounts of other materials to assist in cleaning the surface of the intensifying screen may also be added thereto. (These percentages are by weight.)

Although the preceding description of the composition of the present invention has been described for use with photographic elements, the compositions can be employed with other substrate materials. Illustratively, then compositions can be applied to polymeric materials such as polyester supports, optical disks and transparencies, for example, and with a wide variety of different materials of construction. Also, it is within the scope of the present invention to apply the antistatic composition to the surface of these substrates as a coating present in the matrix thereof.

It is also understood that a careful balancing of the ternary surfactant combinations of this invention will be necessary in order to achieve optimum static protection coating quality and film sensitometry which can be readily determined in accordance with the teachings herein. It is sometimes necessary, as is well-known to those in the art, to heat a solution of the ternary surfactants in order to properly disperse or dissolve these products therein.

Matting agents may also be included within the antiabrasion layers containing the ternary surfactant system of this invention. The addition of an inorganic salt (e.g., LiOAc; NaCl; KCl, etc.) to raise the solution conductivity of the antiabrasion layer from about 800 mhos to 1100–4500 mhos improves the static discharge considerably and represents a preferred system.

It is also understood that in the drying of a photographic element representing this invention it is important to optimize the drying conditions so as to permit the surfactant system to migrate to the surface thereof. Alternate embodiments of this surface phenomena may also be achieved by alternate ways such as applying a super coat thereon or spraying the ternary surfactant thereto after drying.

EXAMPLES 1-23

For testing purposes, the compounds listed below were added to an antiabrasion layer of a silver halide element each of which were prepared in the same manner. In this case, a gelatino silver halide emulsion (ca. 98% Br and ca. 2% I) was prepared, sensitized with gold and sulfur as is well-known to those skilled in the art. The grain size of this emulsion was about 0.22 micrometers. Various coating aids, wetting agents, hardeners, antifoggants and the like were added to this emulsion prior to coating on a 7 mil thick, dimensionally stable, resin and gel subbed polyethylene terephthalate film support. The layer contained 2.75 g/m$^2$ of gelatin and 5.0 g/m$^2$ silver halide. A protective, antiabrasion layer designed to test the efficacy of the ternary surfactant system of this invention was also prepared. This layer, comprised 1.2 g/m$^2$ of gelatin, 24 mg/m$^2$ of polyvinylpyrrolidone and, 50 mg/m$^2$ of polymethylmethacrylate, 12 mg/m$^2$ of picolinic acid, 13 mg/m$^2$ of sodium chrome alum, and 12 mg/m$^2$ of formaldehyde (hardeners). For control purposes an antiabrasion layer comprising all of that described above plus 78 mg/m$^2$ of Triton ®X100, 41.5 mg/m$^2$ of saponin and 6 mg/m$^2$ of Catanac ®SN was also prepared. The ingredients making up the ternary surfactant system of this invention were also added in the amounts shown. These surfactants are keyed to the aforementioned listing under groups (i), (ii) and (iii) respectively as shown above. In each experiment test strips of the single-side coated element were taken for testing as also described above and the results are shown below. Example 9, which also contained KCl, was selected as the best mode considering static protection, coating quality, and sensitometry.

| | SURFACTANT TYPE & CONCENTRATION ADDED TO ANTIABRASION LAYER | | | | | | | |
|---|---|---|---|---|---|---|---|---|
| | (i) | mg/m$^2$ | (ii) | mg/m$^2$ | (iii) | mg/m$^2$ | t ½ (Sec) | Rating |
| Control | | | NONE | | | | 488 | E |
| Example 1 | i-a | (10) | ii-l-I | (16) | iii-j | (12) | 16 | B |
| Example 2 | i-a | (10) | ii-l-I | (32) | iii-h | (12) | 21 | C |
| Exsmple 3 | i-a | (10) | ii-j-III | (36) | iii-l | (5.4) | 4.4 | A |
| Example 4 | i-a | (10) | ii-b-V | (18) | iii-a | (5.4) | 6.0 | B |
| Example 5 | i-a | (5.3) | ii-c-II | (72) | iii-a | (9.4) | 1.8 | A |
| Example 6 | i-e | (20.6) | ii-l-II | (32) | iii-a | (9.4) | 12 | B |
| Exsmple 7 | i-f | (20.6) | ii-l-I | (32) | iii-a | (9.4) | 10 | B |
| Example 8 | i-g | (10.3) | ii-l-I | (32) | iii-a | (9.4) | 3.6 | A |
| Example 9 | i-g | (14.4) | ii-c-II | (47) | iii-f | (7.9) | 0.76 | A |
| Example 10 | i-i | (16.5) | ii-c-II | (39) | iii-h | (24) | 1.8 | A |
| Example 11 | i-g | (16.5) | ii-c-II | (39) | iii-l | (24) | 2.9 | A |
| Example 12 | i-m | (24) | ii-c-II | (45) | iii-a | (9.6) | 4.4 | A |
| Example 13 | i-g | (18) | ii-o-II | (59) | iii-h | (24) | 0.72 | A |
| Example 14 | i-g | (18) | ii-t-II | (79) | iii-H | (24) | 1.5 | A |
| Example 15 | i-g | (18) | ii-n-VII | (79) | iii-h | (24) | 0.88 | A |
| Example 16 | i-g | (18) | ii-n-X | (59) | iii h | (24) | 0.98 | A |
| Example 17 | i-g | (18) | ii-m-II | (59) | iii-h | (24) | 1.8 | A |
| Example 18 | i-g | (18) | ii-m-V | (59) | iii-h | (24) | 1.4 | A |
| Example 19 | i-g | (15) | ii-c-II | (45) | iii-u | (18) | 0.60 | A |
| Example 20 | i-g | (15) | ii-c-II | (45) | iii-r | (18) | 0.62 | A |
| Example 21 | i-g | (15) | ii-c-II | (45) | iii-m | (9) | 0.58 | A |
| Example 22 | i-g | (15) | ii-c-II | (45) | iii-w | (18) | .73 | A |
| Example 23 | i-g | (15) | ii-c-II | (45) | iii-d | (8) | 1.0 | A |

As can readily be seen from these examples, a ternary surfactant system described within this invention, when added to the antiabrasion layer of a silver halide element, significantly reduces the propensity of this element to generate a static charge thereon.

We claim:

1. A photographic light sensitive material containing an antistatic composition capable of decreasing initial voltage of a film to no more than 1100 volts and the t½ to no more than 1 sec. comprising a mixture of:

(i) an anionic surfactant of the following structure:

$$R—X—Y—M$$

wherein

R is alkylene, alkyl, aryl or alkylaryl, and wherein alkyl is 1 to 100 carbon atoms and aryl is 6 to 10 carbon atoms;

X is $—(CH_2—CH_2—O)_a—(CH_2—CH_2—CH_2—O)_b—C_nH_{2n}—$;

a is 1 to 50; b is 0 to 50; n is 0 to 5;

Y is $—SO_3—$ or $—O—SO_3—$; and

M is alkali metal, ammonium or an alkylammonium group;

(ii) a nonionic surfactant of the following structure:

$$R^1—X—A$$

wherein $R^1$ is alkylene, alkyl, alkylcarboxylate, aryl, alkylaryl, alkyenyl, alkylamido, alkylarylamido, alkylsulfoamido, or alkoxy, where alkyl is 1 to 100 carbon atoms and aryl is 6 to 10 carbon atoms;

X is as shown in (i);

A is —OH, H or R as above in (i);

(iii) a nonionic surfactant selected from the group consisting of $$Rf—B—X—A$$

where:

Rf is $C_zF_{2z+1}$ where z is 3-15;

B is $—(CH_2)_t—$ where t is 0 to 10; or $SO_2—N(Q)—R_2—$ where

Q is H or $CH_3$ and $R_2$ is $(CH_2)_s—$, or CO;

s is 0 to 5;

X is the same as in (i) above; and

A is the same as in (ii) above.

* * * * *